US007569994B2

(12) United States Patent
Ikeuchi

(10) Patent No.: US 7,569,994 B2
(45) Date of Patent: Aug. 4, 2009

(54) HIGH-LOAD AND HIGH-INTENSITY DISCHARGE LAMP

(75) Inventor: Mitsuru Ikeuchi, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 418 days.

(21) Appl. No.: 11/392,812

(22) Filed: Mar. 30, 2006

(65) Prior Publication Data

US 2006/0220559 A1 Oct. 5, 2006

(30) Foreign Application Priority Data

Mar. 31, 2005 (JP) ..... 2005-101208

(51) Int. Cl.
*H01J 17/04* (2006.01)
*H01J 19/06* (2006.01)

(52) U.S. Cl. ..... 313/633; 313/346 R

(58) Field of Classification Search ..... 313/346 R, 313/630–633

See application file for complete search history.

(56) References Cited

U.S. PATENT DOCUMENTS 5,530,317 A 6/1996 Willemsen et al.
5,627,430 A 5/1997 Kira et al.
2002/0024280 A1 * 2/2002 Miyamoto et al. ..... 313/346 R
2005/0104521 A1 5/2005 Berndanner et al.

FOREIGN PATENT DOCUMENTS

JP 05-054854 A 3/1993
JP 06-060806 A 3/1994
JP 07-153421 A 6/1995
JP 08-077967 A 3/1996
WO WO03/075310 A 9/2003

* cited by examiner

*Primary Examiner*—Nimeshkumar D. Patel
*Assistant Examiner*—Mary Ellen Bowman
(74) *Attorney, Agent, or Firm*—Rader, Fishman & Grauer, PLLC

(57) ABSTRACT

The present high-load and high-intensity discharge lamp includes a cathode made of a material which does not (substantially) include thorium but can be used as a cathode material of high heat load, so that a long lifetime and high stability corresponding to those of thoriated-tungsten can be realized. Specifically, the cathode is made of a metal base having a high melting point which mainly consists of tungsten and includes a coexisting substance in which an oxide of at least one kind of metal selected from lanthanum, cerium, yttrium, scandium, and gadolinium and an oxide of at least one kind of metal selected from titanium, zirconium, hafnium, niobium, and tantalum are coexistent. The conversion grain size of the coexisting substance is 15 μm or greater, and the plurality of coexisting substances are present in the metal base with a high melting point.

9 Claims, 4 Drawing Sheets

FIG. 2

| Sample No. | Composition of Coexisting Substance | Conversion Grain Size of Coexisting Substance (μm) | Lighting Time (h) | Evaluation |
|---|---|---|---|---|
| Reference Sample 1 | ThO 2 | 12 | 700 | |
| Comparative Sample 1 | ThO 2 | 20 | 300 | |
| Sample 1 | La 2 Zr 2 O 7 | 10 | 250 | X |
| Sample 2 | La 2 Zr 2 O 7 | 15 | 700 | O |
| Sample 3 | La 2 Zr 2 O7 | 22 | 1000 or more | O |
| Sample 4 | La 2 Zr 2 O 7 | 45 | 1000 or more | O |
| Sample 5 | La 2 Zr 2 O 7 | 120 | 1000 or more | O |
| Sample a | La 2 H f2 O 7 | 10 | 400 | X |
| Sample b | La 2 H f2 O 7 | 12 | 800 | O |
| Sample c | La 2 H f2 O 7 | 35 | 1000 or more | O |
| Sample d | La 2 H f2 O 7 | 90 | 1000 or more | O |

HIGH-LOAD AND HIGH-INTENSITY DISCHARGE LAMP

RELATED APPLICATION

The disclosure of Japanese Patent Application No. 2005-101208, filed Mar. 31, 2005, including its specification, claims and drawings, is incorporated herein by reference in its entirety.

TECHNICAL FIELD OF THE INVENTION

The present invention relates to a high-load and high-intensity discharge lamp, and more specifically, to a high-load and high-intensity discharge lamp using a material which does not include thorium as a cathode material used for a high-load and high-intensity discharge lamp.

DESCRIPTION OF RELATED ART

Conventionally, in a high-load and high-intensity discharge lamp such as a xenon short arc lamp, extra high pressure mercury lamp, or rare-gas/mercury short arc lamp, in which the high arc stability and a long lifetime is required, a thoriated-tungsten material (tungsten containing a thorium oxide, of which the chemical sign is ThW) is generally used as a cathode material. However, since thorium contained in the cathode material is a radioactive material, preferably, thorium is not used therefor in view of an environmental load.

Developments of a cathode material in which thorium is not included is being widely performed. For example, a barium oxide which is an electron emitting material as the electrode material is used for a discharge lamp such as a fluorescent lamp or high pressure mercury lamp with low input power, in which the heat load on an electrode is relatively low. Such a technique is disclosed in Japanese Laid Open Patent Application No. 8-77967. According to the publication, a so-called impregnated cathode is proposed, in which barium is included as emitter powder serving as an electron emitting material. Further, a rod body including the emitter material is inserted into the leading end of the cathode and is then sintered.

However, the impregnated cathode including barium is generally used for a discharge lamp having relatively low input power. If the temperature of the cathode increases, barium is likely to be evaporated. Therefore, the impregnated cathode cannot be used for a large-sized discharge lamp in which the current density of the cathode is high, or specifically, a discharge lamp of which the input power is 500 W or more.

On the other hand, various attempts are performed with respect to a relatively large-sized discharge lamp of which the input power is 500 W or more. Generally, it is well known that a material containing an oxide of at least one kind of metal selected from lanthanum, cerium, yttrium, scandium, and gadolinium serving as an electron emitting material (that is other than thorium) in a metal base having a high melting point which mainly consists of tungsten, has excellent electron-emission characteristics. Such a material is being widely used as a cathode material of a discharge lamp. Such a technique is disclosed in Japanese Laid Open Patent Application Nos. 5-54854 and 6-60806. According to the technique disclosed in those publications, a metal oxide such as a lanthanum oxide serving as an electron emitting material is contained in a cathode material of a discharge lamp. Further, it is disclosed that emitters can be stably supplied in case where a discharge lamp with input power of about 1 kW is turned on for at about 1000 hours. However, when a metal oxide which is an electron emitting material such as lanthanum is used as a cathode material of a high-load and high-intensity discharge lamp such as a xenon short arc lamp, extra high pressure mercury lamp, and rare-gas/mercury short arc lamp, the high heat load applied to the cathode material causes lanthanum to be evaporated at an early stage, so that requirements for high input power of 1 kW or more and a long lifetime of 1000 hours or more are not met. Further, compared with a case where a thoriated-tungsten material is used in a cathode material, the lifetime of the lamp becomes shorter, so that it is not suitable for practical use.

In Japanese Laid Open Patent Application No. 7-153421, an electrode material of a high-pressure metal halide discharge lamp which is relatively small-sized and has small input power is disclosed. The electrode material includes $HfO_2$ or $ZrO_2$ serving as a first metal oxide and $Y_2O_3$, $La_2O_3$, $Ce_2O_3$, or $Sc_2O_3$ serving as a second metal oxide.

Further, it is disclosed that the second metal oxide can be stabilized against the heat load by the first metal oxide. However, even though the second oxide is stabilized against the heat load by the first metal oxide, when the electrode material is used for the high-load and high-intensity discharge lamp in which the heat load applied to a cathode material is significantly high, an electron emitting material is evaporated at an early stage. As a result, compared with the case where thoriated-tungsten is used in a cathode, the lifetime of the lamp becomes short.

In addition, International Publication Patent No. WO03/075310 has disclosed a material including $La_2O_3$, $HfO_2$, or $ZrO_2$ as the cathode material of a short arc high-pressure discharge lamp. In the construction thereof, as mentioned above, when the material is used in a high-load and high-intensity discharge lamp in which the heat load applied to the cathode material is significantly high, an electron emitting material is evaporated at an early stage. As a result, compared with the case where thoriated-tungsten is used for a cathode, the lifetime of the lamp becomes shorter.

In general, the operational temperature of the cathode of the high-pressure metal halide discharge lamp or the high-pressure mercury lamp is about 2000° C. in the vicinity of the leading end thereof. On the other hand, the operational temperature of the cathode of the high-load and high-intensity discharge lamp such as the xenon short arc lamp, extra high-pressure mercury lamp, or rare-gas/mercury short arc lamp is in the range of 2400 to 3000° C. Therefore, in the high-pressure metal halide discharge lamp or the like, an electron emitting material may be suppressed from being evaporated, that is, may be stabilized against the heat load.

On the other hand, in the high-load and high-intensity lamp, an electron emitting material should be suppressed not only from being evaporated, but also from being depleted due to high temperature, which has a significant influence on the lifetime of the lamp.

SUMMARY OF THE INVENTION

The present high-load and high-intensity discharge lamp such as a xenon short arc lamp, extra high-pressure mercury lamp, and rare-gas/mercury short arc lamp, includes a cathode, which is made of a material which does not include (or does not substantially include) thorium, but can be used for the cathode subject to high heat load, whereby a long lifetime and high stability corresponding to those of thoriated-tungsten can be realized.

The present invention relates to a high-load and high-intensity discharge lamp in which a stabilizing material is used in order to suppress a metal oxide from becoming liquid phase (liquefied), because it is found that tungsten is oxidized by oxygen separated when a lanthanum oxide or the like serving as an electron emitting material which is contained in the tungsten acts as an emitter, and the tungsten oxide and the lanthanum oxide form a compound with a low melting point, whereby the liquefaction thereof causes the transport rate of emitter to rapidly increase, and the electron emitting material is depleted so that the lifetime of the cathode of the high-load and high-intensity discharge lamp becomes short. Concretely, an oxide of a metal selected from titanium, zirconium, hafnium, niobium, and tantalum for stabilization and an electron-emission oxide coexist, or tungsten and metal selected from titanium, zirconium, hafnium, niobium, and tantalum to suppress a tungsten oxide from being produced are alloyed and caused to act as an oxygen getter.

The present high-load and high-intensity discharge lamp comprises an optically-transparent container that is sealed, an anode and a cathode that are disposed in the container so as to face each other; and sealing sections that project at both ends of the container so as to maintain the air-tightness of the optically-transparent container, electric power being supplied to the anode and the cathode through the sealing sections, wherein the cathode is made from a metal base having a high melting point, which is mainly made of tungsten, the metal base includes coexisting substances in which an oxide of at least one kind of metal selected from lanthanum, cerium, yttrium, scandium, and gadolinium and an oxide of at least one kind of metal selected from titanium, zirconium, hafnium, niobium, and tantalum are coexistent, and a conversion grain size of the coexisting substances is 15 μm or greater.

In such a construction, the temperature at which the oxide is liquefied can be raised, compared with a case where a metal oxide serving as an electron emitting material is present as a single substance. Therefore, the depletion rate of the electron emitting material due to the liquefaction can be controlled. In addition, when a conversion grain size of the coexisting substance of the electron emitting material and stabilizing material is set to 15 μm or more, the electron emitting material can be stably supplied without being easily liquefied, even though the electron emitting material present in the coexistent substance is consumed during the lighting time. As a result, although a high heat load is applied to the leading end of the cathode provided in the high-load and high-intensity discharge lamp using a cathode material in which thorium is not included, arc stability can be enhanced. Further, a high-load and high-intensity discharge lamp having a long lifetime can be provided.

The conversion grain size in the present invention is defined as set forth below.

In the coexisting substances which are present in a measurement range of 0.5 $mm^2$ in a cross section where the cathode is cut in half along the central axis, the diameters of circles which are converted from the areas of the coexisting substances are measured. Among them, the second largest diameter is set to the conversion grain size, except for the largest diameter.

In the present invention, the coexisting substances of which the conversion grain size is 15 μm or more are present in the measurement range. The reason why the measurement range of 0.5 $mm^2$ is taken is that the diameter of the leading end of the cone section which is the leading end of the cathode is generally 0.5 mm. Further, when the vicinity of the leading end of the cone section is measured, the area thereof is easily taken through image processing. The reason why the conversion grain size is measured and the second largest diameter (not the largest diameter) is selected is that an extraordinary value due to various factors is excluded. The method is generally used in statistical processing.

Further, a tungsten oxide may be included in the coexisting substance, so that a high concentration of tungsten oxide layer is suppressed from being produced around the coexisting substance, the coexisting substance is not liquefied, and the electron emitting material is not depleted at an early stage. Further, a high-load and high-intensity discharge lamp with a long lifetime can be provided, in which a stabilized discharge is maintained. Concretely, the phenomenon set forth below occurs. When the coexisting substance acts as an emitter, oxygen is separated from the electron emitting material and lanthanum atom moves inside tungsten which is a metal base with a high melting point, thereby supplying electrons required for the discharge. The oxygen is bonded to tungsten covering the vicinity of the coexisting substance so as to produce a tungsten oxide. Then, a high concentration of thin tungsten oxide layer is produced around the coexisting substance. If the tungsten oxide layer is highly concentrated, the melting point decreases, and the coexisting substance is liquefied even at low temperature. If the liquefaction occurs, the coexisting substance itself is rapidly reduced.

However, when the tungsten oxide is included in the coexisting substance, the tungsten oxide produced around the coexisting substance can be easily diffused into the coexisting substance, whereby a high concentration of tungsten oxide with a low melting point, which is produced when the tungsten oxide is gradually deposited around the coexisting substance, can be suppressed from being produced. As a result, the liquefaction around the coexisting substance caused when a high concentration of tungsten oxide is produced does not occur, and the electron emitting material is not depleted from the coexisting substance at an early stage but is stably supplied. Further, a high-load and high-intensity discharge lamp with a long lifetime can be provided in which stabilized discharge is maintained.

In such a case, a compound with a low melting point which is produced when tungsten reacts with the metal oxide serving as the coexisting substance is not produced, and the liquefaction of the coexisting material can be suppressed. As a result, the electron emitting material is not depleted from the coexisting substance at an early stage but is stably supplied. Further, a high-load and high-intensity discharge lamp with a long lifetime can be provided in which stabilized discharge is maintained.

Further, the content rate of the coexisting substance contained in a tungsten metal base may be 0.3 to 5 percent by weight. That is, when the content of the coexisting substance with respect to the tungsten base is 0.3 percent by weight or more, the sufficient electron emitting materials are supplied so as to maintain the stabilized discharge of the high-load and high-intensity discharge lamp. Further, when the content of the coexisting substance is 5 percent by weight or less, the reduction in heat conductivity as for a cathode material does not occur. When the lamp is turned on so that the temperature of the cone-section leading end of the cathode rises, the cathode can be suppressed from being deformed. As a result, a high-load and high-intensity lamp can be provided in which stabilized discharge is maintained over a long time.

In the high-load and high-intensity discharge lamp, a molar ratio of an oxide $A_xO_y$ of at least one kind of metal selected from lanthanum, cerium, yttrium, scandium, and gadolinium which is included in the coexisting substances to an oxide $B_zO_t$ of at least one kind of metal selected from titanium, zirconium, hafnium, niobium, and tantalum may be in the range of $A/B \leqq 1.0$.

That is, a tungsten base includes an oxide of at least one kind of metal selected from lanthanum, cerium, yttrium, scandium, and gadolinium serving as an electron emitting material except for thorium so that when the electron emitting material acts as an emitter, an oxygen atom separated from the electron emitting material becomes a getter by a stabilizing material composed of titanium, zirconium, hafnium, niobium, or tantalum serving as a material which is more easily bonded to oxygen and can be more stably bonded to oxygen than tungsten composing the cathode, whereby the liquefaction due to a tungsten oxide can be suppressed. Concretely, when the metal oxide serving as an electron emitting material acts as an emitter, the oxygen is separated from the metal oxide and the electron emitting material in the atomic state is diffused into the tungsten base. At this time, the separated oxygen is bonded to peripheral metal so as to produce a metal oxide. In this case, the metal serving as a stabilizing material such as titanium, zirconium, hafnium, niobium, or tantalum which is alloyed with tungsten is more easily bonded to oxygen than tungsten and functions as an oxygen getter. Accordingly, the tungsten can be suppressed from forming a tungsten oxide. As a result, a tungsten oxide with a low melting point is suppressed from being liquefied around the operational temperature of the cathode, and the electron emitting material is stably supplied over a long time so that stabilized discharge can be maintained over a long time. The metal serving as a stabilizing material such as titanium, zirconium, hafnium, niobium, or tantalum which is alloyed with tungsten generally has a lower melting point than tungsten in a metallic state, and the melting point of the tungsten base itself can be lowered due to the alloying. Therefore, the composition ratio of the stabilizing material to tungsten is preferably about 1 atom % or less. Even in such a low concentration, the stabilizing material is more easily bonded to oxygen than tungsten and effectively functions as an oxygen getter.

In the high-load and high-intensity discharge lamp, a leading end of the cathode which performs at least discharge is made of metal whose main component is tungsten, and a surrounding portion thereof is mainly made of metal whose main component is tungsten which contains a metal oxide including an electron emitting material. Therefore, although the heat load increases, the melting and evaporation of tungsten itself is suppressed. Further, since the electron emitting material is supplied around the leading end through the surface diffusion, the wear of the leading end of the cathode is prevented, and stabilized discharge can be maintained. In addition, since the leading end of the cathode does not include the metal oxide, the electron-emission metal oxide is not liquefied, and the deformation of the leading end of the cathode due to rapid eruption or dispersion is prevented. Preferably, the metal oxide is not present in a portion of the leading end of the cathode where the operational temperature exceeds 2000° C. Such a construction can prevent the leading end of the cathode from being deformed over a long time. The portion of the present construction exposed to the discharge is generally a portion across 0.5 to 1.5 mm from the cone-section leading end of the cathode. (FIG. 3)

BRIEF DESCRIPTION OF THE DRAWINGS

These and other features and advantages of the present high-load and high-intensity discharge lamp will be apparent from the following description taken in conjunction with the accompanying drawings.

FIG. 2 is a table showing an effect of the high-load and high-intensity discharge lamp of the present invention;

DETAILED DESCRIPTION OF THE ILLUSTRATED EMBODIMENTS

In a high-load and high-intensity discharge lamp according to an embodiment of the present invention, a coexisting substance in which a metal oxide composed of an electron emitting material such as lanthanum or the like and a metal oxide composed of zirconium or the like serving as a stabilizing material are coexistent with each other is provided, without using thorium as a cathode material, whereby the liquefaction of the electron emitting material at low temperature is suppressed, and further, even when a lamp is driven by high input power or the large-sized high-load and high-intensity discharge lamp is used, as in the case when a thorium material is used for the cathode, the stabilized discharge and a long life time can be realized.

First Embodiment

Figure 1:
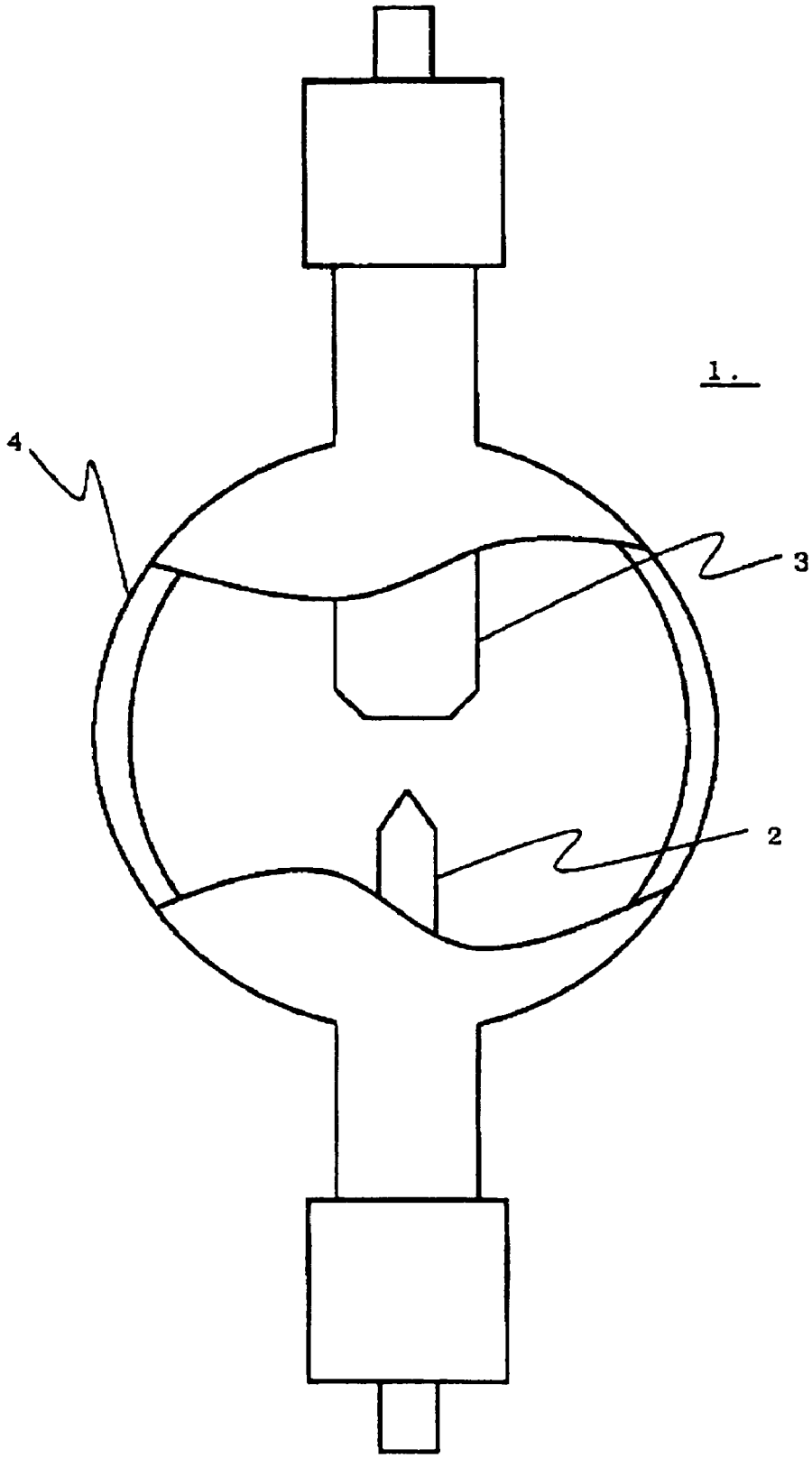
FIG. 1 is a schematic cross sectional view illustrating the shape of a high-load and high-intensity discharge lamp according to the present invention.

FIG. 1 is a schematic view illustrating a high-load and high-intensity discharge lamp according to the present invention.

FIG. 1 shows a rare-gas/mercury short arc lamp 1, in which a rare gas such as xenon is filled in a bulb 4 made of quartz glass and a cathode 2 and anode 3 are disposed to face each other. The anode 3 is formed of pure tungsten whose tungsten content rate is 99.99 percent by weight or more. The cathode 2 mainly consists of tungsten, of which tungsten content is about 98 percent by weight. In such a tungsten base, a lanthanum (La) oxide serving as an electron-emitting material and a zirconium (Zr) oxide or hafnium (Hf) oxide, serving as a stabilizing material for stabilizing the electron-emitting material, are included. For example, coexisting substance in which a lanthanum oxide and a zirconium oxide are coexistent with each other is formed, and a material in which the coexisting substance is contained by 2 percent by weight is used for the cathode 2. An input power of 2 kW is applied to the rare-gas/mercury short arc lamp 1. The distance between the anode and the cathode is 7 mm, xenon is used as a rare gas, and the filling pressure of xenon is 1.5 atmosphere pressure at room temperature. The diameter and length of the cathode are 8 mm and 20 mm, respectively, the apex angle of the cone section which is the leading end of the cathode is 60°, and the diameter of the leading end of the cone section, which is the cutting edge of the cathode, is 0.5 mm.

In order to perform a comparative test with a cathode manufactured by using a thoriated-tungsten material, the high-load and high-intensity discharge lamp is manufactured, such that the lanthanum (La) oxide serving as an electron emitting material and the zirconium (Zr) oxide or hafnium (Hf) oxide serving as a stabilizing material for stabilizing the electron emitting material contained in the tungsten base are used for the cathode. As the high-load and high-intensity discharge lamp for performing the comparative test, a rare-gas/mercury short arc lamp with input power of 2 kW is used, which has the same specification as the above-described high-load and high-intensity discharge lamp. The high-load and high-intensity discharge lamp, which is mainly used as a light source for exposing a semiconductor, is driven by a relatively high current. Further, the amount of filled mercury therein is small, and a heat load on the cathode is significantly large. Although xenon is used as a rare gas to be filled, xenon, krypton, argon, and a mixed gas thereof may be used. When the high-load and high-intensity discharge lamp is normally lit up, the fluctuation rate of light emitted from the high-load and high-intensity discharge lamp is measured by a semiconductor monitor which detects light with a wavelength of 365 nm. A state where the fluctuation rate becomes 1% or more, that is, a lighting time during which arc becomes instable is weight up.

FIG. 2 is a table showing a composition of each coexisting substance, the conversion grain size of each coexisting substance, a time until arc becomes instable, and the result of comparative evaluation. A reference sample 1 shown in FIG. 2 is a thoriated-tungsten electrode which is generally used in the related art and uses a material in which the content of a thorium oxide ($ThO_2$) serving as an electron emitting material in a tungsten base is 2 percent by weight. In the reference sample 1 using thoriated-tungsten electrode according to the related art, arc instability occurs at 700 hours. On the basis of the time, comparative evaluation is performed on other samples.

As for the samples according to the present invention on which the comparative evaluation is performed, coexisting grains of the lanthanum (La) oxide serving as an electron-emitting material and the zirconium (Zr) oxide or hafnium (Hf) oxide serving as a stabilizing material are contained in the tungsten base. As the coexisting substance of the metal oxide serving as an electro-emitting material and the metal oxide serving as a stabilizing material, the metal oxides are contained by 2 percent by weight in the tungsten base as that in the thoriated-tungsten electrode. Samples 1 to 5 use the zirconium (Zr) oxide, and the composition of the coexisting substance thereof is, for example, $La_2Zr_2O_7$. In addition, samples a to d use the hafnium (Hf) oxide, and the composition of the coexisting substance thereof is, for example, $La_2Hf_2O_7$.

Figure 3A:
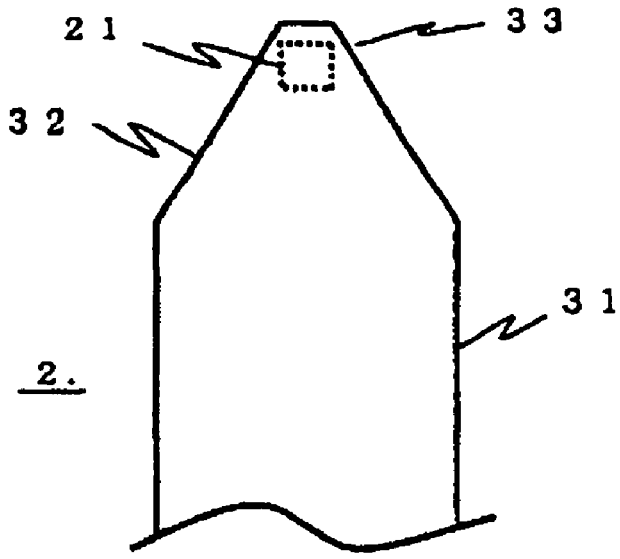
FIGS. 3A-3C are diagrams showing a coexisting substance which is included in a tungsten base according to the present invention.
Figure 3B:
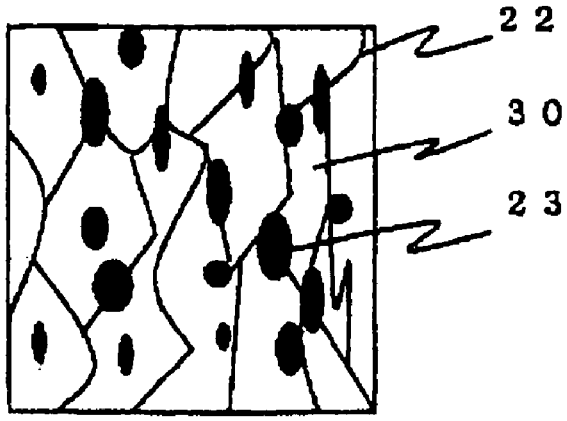
Figure 3C:
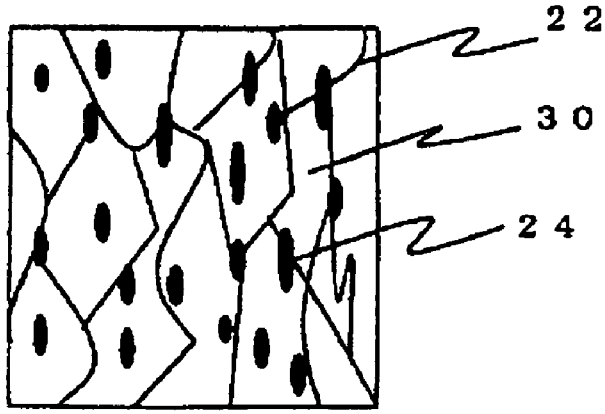

FIGS. 3A-3C show schematic views illustrating the tungsten base containing the coexisting substance. The shape of the metal oxide shown in FIG. 3 is a schematic example, and the shape is changed depending on a material and a manufacturing condition. FIG. 3A is a cross-sectional view in which the cathode 2 used in the rare-gas/mercury short arc lamp is cut in half along the central axis thereof. The cathode 2 is composed of a tungsten base 31 and a cone section 32. In the vicinity of a cone-section leading end 33 which is the leading end of the cone section 32, a measurement range 21 where the coexisting substance is measured is shown by a dashed line. The measurement range 21 is formed in a square shape of which one side is 0.5 mm. FIG. 3B is a conceptual view illustrating the enlarged cross-section of the measurement range 21. In the measurement range 21, a tungsten grain boundary 22 is included, and the coexisting substances 23 are included on the tungsten grain boundary 22 or in tungsten crystal grains 30. In the coexisting substance 23, a lanthanum oxide and zirconium oxide, for example, are mixed. FIG. 3C is an enlarged cross-sectional view of the measurement range 21 in the case of a thoriated-tungsten cathode. On the tungsten grain boundary 22 or in the tungsten crystal grains 30, thoria grains 24 of thoria ($ThO_2$) which is a thorium oxide are present. The thoria grains 24 are dispersed finely and uniformly.

As shown in FIG. 3B, preferably, a ratio of the lanthanum oxide serving as an electron-emitting material to the zirconium oxide serving as a stabilizing material in the coexisting substance 23 will be explained below. That is, a molar ratio of the metal oxide $A_xO_y$ serving as an electron-emitting material to the metal oxide $B_zO_t$ serving as a stabilizing material is preferably in the range of $A/B \leqq 1.0$. That is because, if the ratio of the metal oxide serving as a stabilizing material is reduced so that the molar ratio becomes in the range of $A/B > 1.0$, tungsten reacts with the metal oxide which is the coexisting material 23 to produce a compound with a low melting point.

Although in the present samples the content rate of the coexisting substance 23 to the tungsten base 31 is 2 percent by weight, the coexisting substance 23 is preferably contained by 0.3 to 5 percent by weight. If the content of the coexisting substance 23 is less than 0.3 percent by weight, the supply of electron-emitting material becomes insufficient, and stabilized discharge cannot be performed when a lamp is turned on. In addition, if the content thereof is 5 percent by weight or more, heat conductivity of the electrode material is reduced. Further, the temperature of the cone-section leading end 33 which is the leading end of the cathode rises when a lamp is lit up, and the lifetime of the an electrode becomes shorter.

A group of samples 1 to 5 and a group of samples a to d, which are shown in FIG. 2, have the same condition as each other, except that the grain sizes of the samples indicated by the conversion grain size are different from each other. The conversion grain size indicates the second largest diameter by excluding the largest diameter from the diameters (if a diameter is set to L with respect to an area S, $S=(\pi L^2)/4$) when the areas of the coexisting substances, which are present within the measurement range of 0.5 $mm^2$ in the cross-section where the cathode is cut in half along the central axis, are converted into a circle. In many cases, when the measurement range is taken in a square shape of which one side is 0.5 mm, the diameter of the leading end of the cone section which is the leading end of the cathode is about 0.5 mm, and the vicinity of the leading end of the cone section can be easily observed.

Specifically, the cathode is cut in half along the central axis thereof so that the cross section thereof includes the overall cone section of the cathode, and the cross section is smoothly ground. Then, the cross sectional image thereof is photographed by an optical microscope or an electron microscope so that the metal base in the cross section which mainly consists of tungsten and the metal oxides as the coexisting substances which are granulated in the metal base can be distinguished. The photographed image is converted on the cross section (image) to calculate diameters of circles which converted from the areas of the coexisting substances which are in the measurement range having a square shape of which one side is 0.5 mm. Here, as for the resolution of the measurement range, a square whose width is 0.5 μm is measured as one pixel, the tungsten base and the coexisting substances are processed as binary data, whereby the data of the coexisting substances are converted from the image processing data. As a conversion equation, the equation where the diameter is calculated from the area S is used, and a converted value is calculated to a unit of μm by rounding off. Among the diameters, the second largest diameter by excluding the largest diameter within the measurement range is set to the conversion grain size within the measurement range. In practice, the cone section which is the leading end of the cathode is measured, or specifically, the vicinity of the leading end is measured.

The conversion grain size of the thoriated-tungsten electrode as a comparative sample 1 of FIG. 2 is larger than that of the reference sample 1 which is a conventional thoriated-tungsten electrode. In this case, arc instability occurs at 300 hours, which is shorter than in the reference sample 1. In the case of general thoriated-tungsten where a metal oxide serving as an electron-emitting material is finely dispersed, the electron-emitting material can be stably supplied. However, in the case of the comparative sample 1 of which the conversion grain size is enlarged, the supply of the electron-emitting material is not sufficient so that arc becomes instable.

On the other hand, in the samples 1 to 5, time period during which arc instability occurs is longer as the conversion grain size becomes large, which is contrary to the thoriated-tungsten electrode. In the samples having a diameter of 15 μm or more, the same discharge as in the conventional thoriated-tungsten electrode which is the reference sample 1 or more stabilized discharge is maintained. Further, in the samples having a diameter of 12 μm or more among the samples a to d, more stabilized discharge than in the conventional thoriated-tungsten electrode which is the reference sample 1 is maintained for a long time. According to these results, if the conversion grain size of the coexisting substance is 15 μm or more in comparison with the conventional thoriated-tungsten electrode, a high-intensity and high-illumination discharge lamp with a long lifetime can be provided in which the same discharge as in the thoriated-tungsten electrode or more stabilized discharge is maintained. However, if the conversion grain size of the coexisting substance exceeds 100 μm, the mechanical strength of the cathode material itself is weakened. For example, when the cathode is processed, a crack occurs therein. Therefore, the conversion grain size is preferably in the range of 15 to 100 μm.

In the present embodiment, the high-load and high-intensity lamp maintains stabilized discharge and has a long lifetime when the conversion grain size of the coexisting substance is large, which is different from the case of the thoriated-tungsten electrode. The metal oxide serving as an electron emitting material is reduced as the temperature of the cathode becomes high at the time of the operation of the high-load and high-intensity lamp. At this time, oxygen is separated from the metal oxide, and is transported to the leading end of the cathode as the electron emitting material is diffused into the tungsten base. Further, by lowering the work function allows the thermo-electronic emission to be easily performed.

On the other hand, the separated oxygen is bonded to tungsten to produce a tungsten oxide. Tungsten is not easily diffused into another oxide while being in the metallic state. However, a tungsten oxide is easily diffused into another oxide. In the present embodiment, the produced tungsten oxide starts to be diffused into the coexisting substance in which the metal oxide composed of the electron emitting material and the metal oxide serving as a stabilizing material are coexistent. In this case, when the metal oxide composed of the electron emitting material such as lanthanum, cerium, yttrium, scandium, or gadolinium and the tungsten oxide are coexistent, the melting point of the metal oxide tends to be low as the proportion of the tungsten oxide therein increases. If a large amount of tungsten oxide is contained, the metal oxide is liquefied even at a temperature below the operational temperature of the cathode. Once the coexisting substance is liquefied, the diffusion rate significantly increases, compared with a case when the coexisting substance is solid. The prompt diffusion causes the electron emitting material to be emitted outside the electrode. After that, the electron emitting material is depleted and the supply amount thereof is reduced so that stabilized discharge cannot be maintained.

An amount of tungsten oxide which is diffused into the grain of the coexisting material is determined by the grain size of the coexisting material, that is, the surface area thereof. The proportion of the tungsten oxide in the coexisting substance is expressed by a relational expression of (the volume of the coexisting substance/the surface area of the coexisting substance). The larger the conversion grain size of the coexisting substance is, the smaller the proportion of the tungsten oxide becomes. If the grain size of the coexisting substance is large, the proportion of the tungsten oxide therein is maintained to be low, and the melting point is suppressed from decreasing. Further, without liquefying the coexisting substance, the electron emitting material can be supplied over a long time. As the number of large grains of the coexisting substance becomes large, the supply is stably performed over a long time, and stabilized discharge can be maintained.

As such, although the grain of the coexisting substance needs to be large, various measures can be taken in order to control the grain size of the coexisting substance. For example, since tungsten serving as a cathode material is produced by a powder metallurgy process, the grain size of the coexisting substance can be controlled by assorting the powder grain size of the metal oxide composed of the electron emitting material, which is supplemented to starting material powder before sintering, and the powder grains size of the metal oxide serving as a stabilizing material. In addition, the coexisting substance can constantly maintain an expression of (the grain size of the starting material powder)/(the grain size of the large grain of the coexisting substance) by determining conditions such as atmosphere, temperature, time at the time of sintering. Further, a sintered body including the coexisting substance is rotary-hammered to reduce the diameter thereof, so that the coexisting substance is extended and ground to minute portions. The grain size of the coexisting material can be controlled by controlling the reduction rate of the cross-sectional area of the sintered body at this time.

As an example of a method of manufacturing the cathode material described in the first embodiment, a case where a lanthanum oxide and zirconium oxide are produced as a coexisting substance will be described below. First, the powder of the lanthanum oxide having an average grain size of 20 μm or less and the powder of the zirconium oxide having an average grain size of 20 μm or less are mixed in a ball mill and sintered in the atmosphere at 1400° C. (degrees Celsius) after pressing. Then, the sintered body is again ground to obtain the oxide powder in which the lanthanum oxide and the zirconium oxide are coexistent. Further, powder having a grain size of 10 to 20 μm is obtained by classifying the coexisting oxide powder. The obtained powder and tungsten powder having a purity of 99.5 percent by weight or more and an average grain size of 2 to 20 μm are mixed, pressed, and half-sintered in hydrogen. After that, the half-sintered body is normally sintered by applying an electric current. The sintered body is swaged to obtain an electrode material having a theoretical density of higher than 95%. The electrode material manufactured in such a manner is processed in a desired electrode shape and is further heated in vacuum at 1900° C. for one hour so as to be degassed. Then, the electrode material is integrated as a cathode into a high-load and high-intensity discharge lamp. If the theoretical density of the tungsten including the coexisting substance is less than 95%, when the electrode is integrated in a lamp to be driven, the leading end of the electrode is contracted and deformed or the wear of the leading end of the cone section of the electrode increases due to heat conduction. Therefore, the sintered body needs to be swaged carefully.

The crystal grain of tungsten can be extended in the axis direction of the electrode by adjusting the reduction rate of the cross-sectional area in the swaging process after sintering. By extending the crystal grain of tungsten in the axis direction of the electrode, the transport of electron emitting material is performed along the crystal grain. Since the crystal grain is formed toward the leading end of the electrode, the electron emitting material can be stably supplied to the leading end.

Similarly, the coexisting substance which is present in the tungsten base can be extended in the axis direction of the electrode by adjusting the reduction rate of the cross-sectional area in the swaging process after sintering. With the coexisting substance being extended in the axis direction of the electrode, the transport of the electron emitting material is performed. In this case, since the transport path is formed toward the leading end of the electrode, the electron emitting material can be stably supplied to the leading end.

If 1 to 100 weight ppm of gallium is contained in the electrode material, the crystal grain growth of tungsten itself can be controlled, and the size of the crystal grain can be stably maintained. Further, the supply amount when the electron emitting material is transported along the crystal grain boundary of tungsten can be stably maintained.

Second Embodiment

As a second embodiment, a high-load and high-intensity discharge lamp in which a cathode material including a tungsten oxide in a coexisting substance is used will be described. As the cathode material, the coexisting substance, in which a lanthanum oxide serving as an electron emitting material, a hafnium oxide serving as a stabilizing material, and a tungsten oxide are mixed, is provided. With the tungsten oxide being included in the coexisting substance, the tungsten oxide produced around the coexisting substance can be easily diffused into the coexisting substance by the oxygen separated from the coexisting substance when the lanthanum oxide serving as an electron emitting substance acts as an emitter. Further, it can be prevented that a high concentration of tungsten oxide is produced as the tungsten oxide is gradually deposited around the coexisting substance. As a result, the liquefaction around the coexisting substance does not occur, which can be caused by a high concentration of tungsten oxide. Further, the electron emitting material is not depleted from the coexisting substance at an early stage, but is stably supplied. Therefore, it is possible to provide a high-load and high-intensity discharge lamp with a long lifetime which can maintain stabilized discharge.

The manufacturing of the cathode material can be performed in a procedure set as set forth below. The powder of a lanthanum oxide having an average grain size of μm or less, powder of a hafnium oxide having an average grain size of 20 μm or less, and powder of a tungsten trioxide ($WO_3$) are mixed in a ball mill, and is sintered in the atmosphere at about 1500° C. after pressing. Then, the sintered body is ground to the powder of coexisting material. The powder of coexisting material is classified, and thus mixed powder having an average grain size 10 to 20 μm is obtained. The subsequent process is the same as the case where the electrode material is manufactured in the first embodiment. Accordingly, a tungsten base containing a coexisting substance of $La_2O_3$—$HfO_2$—$WO_3$ can be manufactured. A xenon short arc lamp with an input power of 2 kW is manufactured by using the cathode. The conversion grain size of the coexisting substance in the cathode is about 22 μm, the diameter of the cathode is 8 mm, the length thereof is 20 mm, the apex angle of the cone section which is the leading end of the cathode is 60°, and the diameter of the leading end of the cone section, which is the cutting edge of the cathode, is 0.5 mm. In the present embodiment, the coexisting substance is contained by 4 percent by weight in the tungsten base. Further, a luminance maintenance rate of the high-load and high-intensity discharge lamp is compared in case thoriated-tungsten is used for the cathode material. In the present embodiment, when light emitted from the xenon short arc lamp is irradiated on a screen by a screen projection device, a time until the flickering is observed by eye is measured. In the present embodiment, similarly to the case where the thoriated-tungsten cathode is used, the flickering occurs at 1000 hours after the lamp is lit up, and the same characteristic as the thoriated-tungsten cathode is obtained.

Third Embodiment

In a third embodiment of the present invention, zirconium serving as a stabilizing material is alloyed with a metal base composed of tungsten, and a cathode material including a tungsten oxide serving as a granulated electron emitting material in the metal base is used for a high-load and high-intensity lamp. The form of the cathode material is shown in FIG. 3B. In the drawing, tungsten crystal grains 30 form an alloy of tungsten and zirconium, and lanthanum oxide grains are contained instead of the coexisting substance 23. In the present embodiment, when the lanthanum oxide serving as the electron emitting material acts as an emitter, oxygen is separated from the lanthanum oxide, lanthanum atom moves inside the tungsten which is the metal base with a high melting point, thereby supplying electrons required for discharge. At this time, the separated oxygen is gradually deposited on the uppermost surface of the lanthanum oxide. The oxygen is bonded to tungsten covering the vicinity of the lanthanum oxide so as to produce a tungsten oxide. Then, around the coexisting material, a high concentration of thin tungsten oxide layer is produced. If the tungsten oxide layer is highly concentrated, a melting point thereof is lowered, and the tungsten oxide is liquefied even at low temperature. Further, tungsten has not been diffused into the lanthanum oxide while being in the metallic state. However, when the tungsten becomes an oxide, the tungsten oxide is diffused into the lanthanum oxide so as to form a compound of the lanthanum oxide and tungsten oxide. The compound has a lower melting point than the lanthanum oxide and is liquefied around the driving temperature of the cathode. In this case, if zirconium serving as a stabilizing material is included in the form of alloy with tungsten in the metal base, the zirconium acts as an oxygen getter with respect to the oxygen separated from the electron emitting material so as to suppress a tungsten oxide from being produced. As a result, the tungsten oxide diffused into the lanthanum oxide does not form a compound with a low melting point, and the lanthanum oxide is not liquefied. When the cathode material is used for the high-load and high-intensity lamp, stabilized discharge can be maintained over a long time.

In the present embodiment, the cathode material in which zirconium and tungsten are alloyed is integrated in an extra high pressure mercury lamp, and is compared with the case where thoriated-tungsten is used for a cathode. The extra high pressure mercury lamp is generally used for manufacturing a color filter for liquid crystal or the like. The input power thereof is 5 kW, the xenon is filled as a rare gas, the filling pressure of xenon is 1 atmosphere pressure at room temperature, and a relatively large amount of mercury is filled therein. The composition of the cathode of the extra high pressure mercury lamp contains an alloy of tungsten (W) and zirconium (Zr) and the lanthanum oxide ($La_2O_3$). The grain size of the metal oxide is about 35 μm by the conversion grain size. Further, the diameter of the cathode is 12 mm, the length thereof is 20 mm, the apex angle of the cone section which is the leading end thereof is 80°, and the diameter of the leading end of the cone section, is 0.6 mm. Time until arc instability occurs at a wavelength of 405 μm in the extra high pressure mercury lamp is compared with the case where thoriated-tungsten is used in a cathode. For the arc instability, the fluctuation rate of light emitted from the high-load and high-intensity discharge lamp is measured by a semiconductor monitor which detects light at a wavelength of 405 μm. The arc instability is a state where the fluctuation rate is 1% or more. When the thoriated-tungsten cathode is used, arc instability occurs at 1000 hours after the lamp is lit up. Even in the present embodiment, arc instability also occurs at 1000 hours after the lamp is lit up.

In order to manufacture such a cathode material, tungsten powder having an average grain size of 2 to 20 μm and zirconium hydride powder are mixed in a ball mill, pressed, and heated in vacuum at 1200° C. In this step, zirconium is diffused into the tungsten powder. The heated body is ground to W—Zr alloy powder. Then, the W—Zr alloy powder is ground and classified to obtain the W—Zr alloy powder having an average grain size of 20 μm or less. The obtained W—Zr alloy powder and the tungsten powder having an average grain size of 10 to 20 μm are mixed, and then half-sintered in an inert gas at about 1000° C. after pressing. The half-sintered body is normally sintered in an inert gas at about 1600° C. and is further electrically sintered in hydrogen. The sintered body is swaged to obtain an electrode material having a theoretical density of 95% or higher. After being processed in a desired electrode shape, the electrode material is heated in vacuum for one hour at 1900° C. and then degassed. The cathode manufactured in such a manner is integrated in the high-load and high-intensity lamp to manufacture the sample.

Fourth Embodiment

Figure 4:
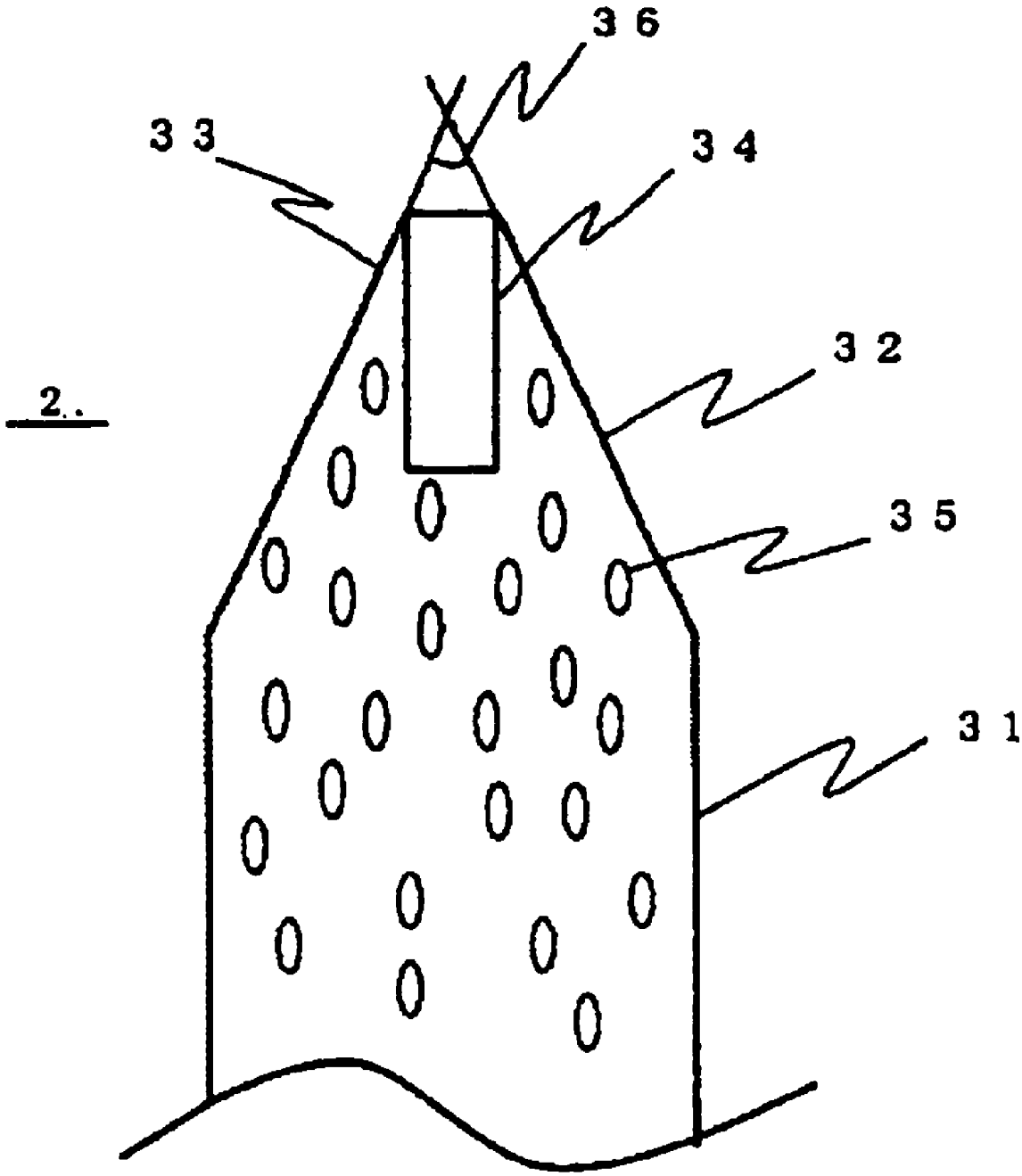
FIG. 4 is a schematic enlarged cross-sectional view illustrating the shape of a cathode according to the present invention.

FIG. 4 is a schematic cross-sectional view illustrating a cathode 2 as a fourth embodiment according to the present invention. The cathode 2, which mainly consists of tungsten, is composed of a tungsten base 31 in which an alloy of tungsten and zirconium are contained, a cone section 32 formed in the leading end of the tungsten base 31, and a rod body 34 made of pure tungsten which is embedded in a cone-section leading end 33 which is the leading end of the cone section 32. The tungsten base 31 includes a granulated portion in which a lanthanum oxide and zirconium oxide are coexistent as a coexisting substance 35. Concretely, the diameter of the tungsten base 31 is 12 mm, the length thereof is 30 mm, the apex angle 36 of the cone section 32 is 80°, and the diameter of the cone-section leading end 33 of the cone section 32 is 1.0 mm. On the cone-section leading end 33 of the cone section 32, a hole having a diameter of 1.0 mm and a depth of 3.0 mm is provided. The rod body 34 made of tungsten is pressed into the hole and is integrated with the tungsten base 31 by laser-melting the cone-section leading end 33. Further, a portion across 0.5 mm from the cone-section leading end 33 is formed of tungsten which does not include a metal oxide. The conversion grain size of the coexisting substance 35 at this time is about 25 μm, and the content thereof with respect to the tungsten base 31 is 0.5 percent by weight. As the high-load and high-intensity lamp in which the cathode 2 manufactured in such a manner is integrated, a rare-gas/mercury short arc lamp with input power of 5 kW is manufactured. In the rare-gas/mercury short arc lamp, a mixed gas of argon and krypton is filled as a rare gas at 1 atmosphere pressure at room temperature. In the same rare-gas/mercury short arc lamp as described above, a thoriated-tungsten cathode is integrated, and the comparison with the present embodiment is performed. Similarly to the case of the first embodiment, the evaluation is performed such that the fluctuation rate is measured at a wavelength of 365 μm, and the lighting time until the fluctuation rate becomes 1% or more. The lighting time of the rare-gas/mercury short arc lamp of the present embodiment is the same as that of the case where a thoriated-tungsten is used in the cathode material.

The tungsten base 31 forming the cathode 2 in the present embodiment is manufactured according to, for example, a method described below. Tungsten powder having an average grain size of 2 to 20 μm and zirconium hydride powder are mixed in a ball mill, is pressed, and is heated in vacuum at 1200° C. In this step, zirconium is diffused into the tungsten powder. The heated body is ground to obtain W—Zr alloy powder. The W—Zr alloy powder is classified to obtain the W—Zr alloy powder having an average grain size of 20 μm or less. Next, powder of a lanthanum oxide having an average grain size of 20 μm or less and powder of a zirconium oxide are mixed in a ball mill, and are sintered in the atmosphere at 1500° C. after pressing. Then, the sintered body is ground to metal oxide powder in which the lanthanum oxide and zirconium oxide are coexistent. The coexisting metal oxide powder is classified to obtain powder having a grain size of 10 to 20 μm. The previously obtained W—Zr alloy powder and the last-obtained coexisting metal oxide powder are mixed, are pressed, and are preliminarily sintered in an inert gas at about 1000° C. After that, the half-sintered body is normally sintered in an inert gas at 1600° C. and is further electrically sintered in hydrogen. The sintered body is swaged to obtain an electrode material having a theoretical density of 95% or higher. The electrode material manufactured in such a manner is processed in a desired electrode shape and is further heated in vacuum at 1900° C. for one hour so as to be degassed.

The tungsten base 31 used in the present embodiment contains the coexisting substance 35 in which a metal oxide selected from lanthanum, cerium, yttrium, scandium, or gadolinium, serving as an electron emitting material and a metal oxide selected from titanium, zirconium, hafnium, niobium, or tantalum, serving as a stabilizing material are coexistent and the alloy formed by tungsten of the tungsten base 31 and metal selected from titanium, zirconium, hafnium, niobium, or tantalum, in base metal with a high melting point which mainly consists of tungsten. Although in the above example, the rod body 34 made of 99.99 percent by weight of tungsten is disposed in the leading end of the cathode 2 made of the tungsten base 31, the cathode 2 can be made by only the tungsten base 31 without using the rod body 34.

What is claimed is:

1. A high-load and high-intensity discharge lamp comprising:

an optically-transparent container that is sealed;

an anode and a cathode that are disposed in the container so as to face each other; and sealing sections that project at both ends of the container so as to maintain the air-tightness of the optically-transparent container, electric power being supplied to the anode and the cathode through the sealing sections, wherein the cathode is made from a metal base having a high melting point, which is mainly made of tungsten, the metal base includes coexisting substances in which an oxide of at least one kind of metal selected from lanthanum, cerium, yttrium, scandium, and gadolinium and an oxide of at least one kind of metal selected from titanium, zirconium, hafnium, niobium, and tantalum are coexistent, and a conversion grain size of the coexisting substances is 15 μm or greater.

2. The high-load and high-intensity discharge lamp according to claim 1, wherein the coexisting substances include a tungsten oxide.

3. The high-load and high-intensity discharge lamp according to claim 1, wherein a content rate of the coexisting substances contained in the metal base is 0.3 to 5 percent by weight.

4. The high-load and high-intensity discharge lamp according to claim 1, wherein a molar ratio of an oxide $A_xO_y$ of at least one kind of metal selected from lanthanum, cerium, yttrium, scandium, and gadolinium which is included in the coexisting substances to an oxide $B_zO_t$ of at least one kind of metal selected from titanium, zirconium, hafnium, niobium, and tantalum is in the range of $A/B \leqq 1.0$.

5. The high-load and high-intensity discharge lamp according to claim 1, wherein a leading end of the cathode which performs at least discharge is made of metal whose main component is tungsten, and a surrounding portion thereof is mainly made of metal whose main component is tungsten which contains a metal oxide including an electron emitting material.

6. The high-load and high-intensity discharge lamp according to claim 2, wherein a leading end of the cathode which performs at least discharge is made of metal whose main component is tungsten, and a surrounding portion thereof is mainly made of metal whose main component is tungsten which contains a metal oxide including an electron emitting material.

7. The high-load and high-intensity discharge lamp according to claim 3, wherein a leading end of the cathode which performs at least discharge is made of metal whose main component is tungsten, and a surrounding portion thereof is mainly made of metal whose main component is tungsten which contains a metal oxide including an electron emitting material.

8. The high-load and high-intensity discharge lamp according to claim 4, wherein a leading end of the cathode which performs at least discharge is made of metal whose main component is tungsten, and a surrounding portion thereof is mainly made of metal whose main component is tungsten which contains a metal oxide including an electron emitting material.

9. A cathode for a high-load and high-intensity discharge lamp, wherein the cathode is made from a metal base having a high melting point, which is mainly made of tungsten, the metal base includes coexisting substances in which an oxide of at least one kind of metal selected from lanthanum, cerium, yttrium, scandium, and gadolinium and an oxide of at least one kind of metal selected from titanium, zirconium, hafnium, niobium, and tantalum are coexistent, and wherein a conversion grain size of the coexisting substances is 15 μm or greater.

* * * * *